United States Patent [19]

Langfield et al.

[11] 4,114,951

[45] Sep. 19, 1978

[54] HYDRAULICALLY ACTUATED TOOL FOR MECHANICALLY SPLITTING ROCK-LIKE MATERIAL

[75] Inventors: Edward R. Langfield, Glen Rock; James L. Hile, Montville; David L. Hird, Pompton Lakes, all of N.J.

[73] Assignee: Edward R. Langfield, Glen Rock, N.J.

[21] Appl. No.: 795,074

[22] Filed: May 9, 1977

[51] Int. Cl.[2] ..... E21C 37/04

[52] U.S. Cl. ..... 299/22; 299/20; 299/23; 166/177

[58] Field of Search ..... 299/22, 23, 20, 21; 254/104; 144/193 A; 125/23 R, 24; 166/177, 178

[56] References Cited

U.S. PATENT DOCUMENTS 3,957,309 5/1976 Darda ..... 299/22

FOREIGN PATENT DOCUMENTS 580,223 8/1976 Switzerland ..... 299/22

*Primary Examiner*—Ernest R. Purser
*Assistant Examiner*—Nick A. Nichols, Jr.
*Attorney, Agent, or Firm*—Ralph R. Roberts

[57] ABSTRACT

A rock splitter tool is hydraulically actuated by a piston which moves a tapered wedge between feathers mounted at one end in a retaining means. The feathers and wedge, as an assembly, are inserted into a predrilled hole and the wedge is driven forward by the hydraulic piston to move the feathers outwardly to split the rock. The present invention is directed toward providing a hydraulically moved wedge in which the feathers and wear plate portions are retained by a clam shell clamp and retainer which are readily separated and removed to enable an inspection and/or replacement of any damaged apparatus. This clam shell clamp enables existing apparatus to be converted. Auxiliary apparatus utilizing a jack hammer device is also shown as is a hydraulic pulsation developing rotary valve which is adapted to cycle the wedge as it is moved forwardly.

35 Claims, 33 Drawing Figures

HYDRAULICALLY ACTUATED TOOL FOR MECHANICALLY SPLITTING ROCK-LIKE MATERIAL

BACKGROUND OF THE INVENTION

1. Field of the Invention

With reference to the classification of art as established in and by the United States Patent and Trademark Office, the present invention is believed to be found in the general Class entitled, "Mining or in Situ Disintegration of Hard Material" (Class 299) and in the subclass entitled, "expansible breaking down devices - piston" (subclass 22) and the subclass using a "wedge" (subclass 23).

2. Description of the Prior Art

The use of a wedge and feathers to split rock and coal is well known. The forcing of a wedge between feather members to cause a side force to be developed has been shown in patents and apparatus for more than fifty years. The moving of a wedge member forwardly and backwardly by a hydraulic piston apparatus is also well known.

Nine U.S. Patents to H. DARDA of Germany have employed a hydraulic cylinder to move a wedge between two held feathers. These patents include U.S. Pat. Nos. 3,414,328 as issued on Dec. 3, 1968; 3,439,954 as issued on Apr. 22, 1969; 3,488,093 as issued on Jan. 6, 1970; 3,526,434 as issued on Sept. 1, 1970; 3,791,698 as issued on Feb. 12, 1974; 3,883,178 as issued on May 13, 1975; 3,894,772 as issued on July 15, 1975; 3,957,309 as issued on May 18, 1976, and 3,995,906 as issued on Dec. 7, 1976.

In addition, patents of note are U.S. Pat. Nos. 2,093,452 to JOY as well as 3,550,191 and 3,572,840 to FLETCHER.

In these and other known rock splitting apparatus, the barrel is joined to an extension in which the piston rod is carried out in which the upper ends of the feathers are mounted in a sleeve member which is secured in a more-or-less permanent manner to the barrel. In these known arrangements, the retaining of the wedge is usually through an aperture in the side wall of this extension. In a like manner, the feathers are either brought in through the side of this extension or secured by pins engaged and retained in holes in this extension.

In the breaking of concrete and hard, large rocks, the DARDA apparatus Models 2, 2W, 3, 3W, 5, 5W and C-8 have been sold and are used in the United States as portable units which can be and are taken to a job for splitting rock and concrete. In these and other like apparatus damage does occur. Often this damage is to the wedge, feathers and/or to the wear plates which are used with the feathers in the rock splitting apparatus. Often this damage cannot be determined until and after damage has progressed beyond a repair point. Many repairs in addition to the wedge and feather replacement require a replacement of the lower barrel extension.

The basic concept and construction of the DARDA tool employs a hydraulic splitting cylinder which contains one plug and two feathers. This assembly is inserted into a pre-drilled hole with the plug in a retracted position. When the control lever is turned to forward position, the plug advances and the two feathers are forced sidewards against the wall of the hole and with hundreds of tons of pressure tears rock or concrete apart. With the control lever on top of the cylinder, the plug can be advanced, retracted or held in any position. A break usually occurs within 10 seconds but with extremely hard material, it could be up to 60 seconds.

In the use of the splitter, shown in U.S. Pat. No. 3,414,328, damage to the wedge, feathers and the piston guide member (No. 42 in FIG. 6) can occur when the operator moves or allows the tool to move sideward during splitting of the rock. Damage to the hardened rings or wear plates can also occur. In the splitter shown in U.S. Pat. No. 3,957,309, the screwed-in tubular element 56 of FIG. 5, the wear plates 64 and the wedge and feathers are very prone to damage. This apparatus, as used in commercial applications, is the DARDA Model No. 8 and is shown in FIGS. 5, 6 and 7 of U.S. Pat. No. 3,957,309. This wedge is pivotally secured at its upper end and the feathers are retained by springs 71. When rock of varying hardness is drilled and then split, it often results in a side movement of the wedge and feathers and a resulting damage to the wedge, feathers, housing 56 and the upper and lower wear plates 64 and 65. Replacement of the lower housing or shell requires a matching of the threaded end into the upper cylinder shell.

The present invention is directed toward a rock splitter in which the wedge and feathers are readily mounted and secured to provide inspection, replacement and repair. Instead of a lower tubular housing secured by a thread into the cylinder housing, there is provided a clam shell assembly which mounts into and onto exterior grooves formed in the cylinder barrel. As a repair or conversion for an existing DARDA splitting unit, the lower barrel portion is cut off and the grooves are formed in the remaining member portion. A clam shell retainer holds replaceable, throw-away wear washers, a wedge, a pair of feathers and a rubber retainer. These members are all held in place by a clamp strap. Ready removal of this clamp strap is contemplated so that inspection of the wear washers, the wedge, feathers and the clam shell retainers is easily made.

SUMMARY OF THE INVENTION

This invention may be summarized at least in part with reference to its objects.

It is an object of this invention to provide, and it does provide, a hydraulically actuated rock splitting apparatus or tool in which a wedge is moved forwardly to cause an outward movement of a pair of feathers insertable in a bored hole. The feathers and wear plates are used with the retained ends of the feathers secured by clam shell clamp portions. These clamps are readily removed for inspection of the wedge, feathers and wear plates.

It is a further object of this invention to provide, and it does provide, a rock splitting apparatus allowing and encouraging inspection and replacement of the wedge, feathers and wear plate of the splitter. This apparatus may provide a conversion of an existing but damaged unit in which the lower member is cut off at a point above the feather retaining portion of the original unit. At least one groove is formed in the exterior surface of this barrel portion. A clam shell pair is clamped to this lower barrel and retains the feathers, a pair of wear plates and a rubber washer acting as a dust shield.

In the rock splitting apparatus, to be hereinafter more fully described, provision is made so that the lower portion containing the wedge and enlarged holding ends of the feathers is readily opened for inspection. A simple clamp is employed to hold a clam shell-type retaining means to a grooved end of a lower barrel portion of the cylinder apparatus. The wedge, feathers, wear plates and rubber dust shield are assembled in place in a clam shell member and then the other of the clam shell member is brought into position and an outside clamp is tightened to retain the clam shell members in closed condition.

Also shown are embodiments in which a rapidly reciprocating cylinder-type of hammer apparatus is additionally used in combination with a hydraulic piston-type rock splitter.

In alternate embodiments there is shown a cylinder in which piston travel is controlled by stops. These stops may be on the piston or on the closed or the open end of the cylinder. In one embodiment an adjustable stop is carried in this closed end of the cylinder. An alternate retaining means for retaining the feathers in formed sockets in the clam shell portions is also shown.

Also shown and described are alternate means for retaining the feathers and the wear plates. The wear plates are also shown with curved faces to permit small amounts of swing of the feathers without damage to the T-end of the feathers as they are moved in and out by the reciprocation of the wedge.

A pulsation of the hydraulic piston by alternately feeding pressurized fluid to the forward and return sides of the piston is shown in a rotary valve assembly.

In addition to the above summary, the following disclosure is detailed to insure adequacy and aid in understanding of the invention. This disclosure, however, is not intended to cover each new inventive concept therein no matter how it may later be disguised by variations in form or additions of further improvements. For this reason there has been chosen a specific embodiment of the retaining of the feathers by a clam shell apparatus. Also a use of a jack hammer apparatus and a pulsation valve as adopted for use with rock splitters and showing a preferred means for using this apparatus in predrilled holes is disclosed. These embodiments have been chosen for the purpose of illustration and description as shown in the accompanying drawings wherein:

BRIEF DESCRIPTION OF THE DRAWINGS

In the following description and in the clams various details are identified by specific means for convenience. These names are intended to be generic in their application with corresponding reference characters referring to like members throughout the several figures of the drawing.

The drawings accompanying, and forming part of, this specification disclose certain details of construction for the purpose of explanation but it should be understood that these details may be modified in various respects and that the invention may be incorporated in other structural forms than shown.

DESCRIPTION OF THE EMBODIMENT OF FIGS. 1, 2 AND 3

Figure 1:
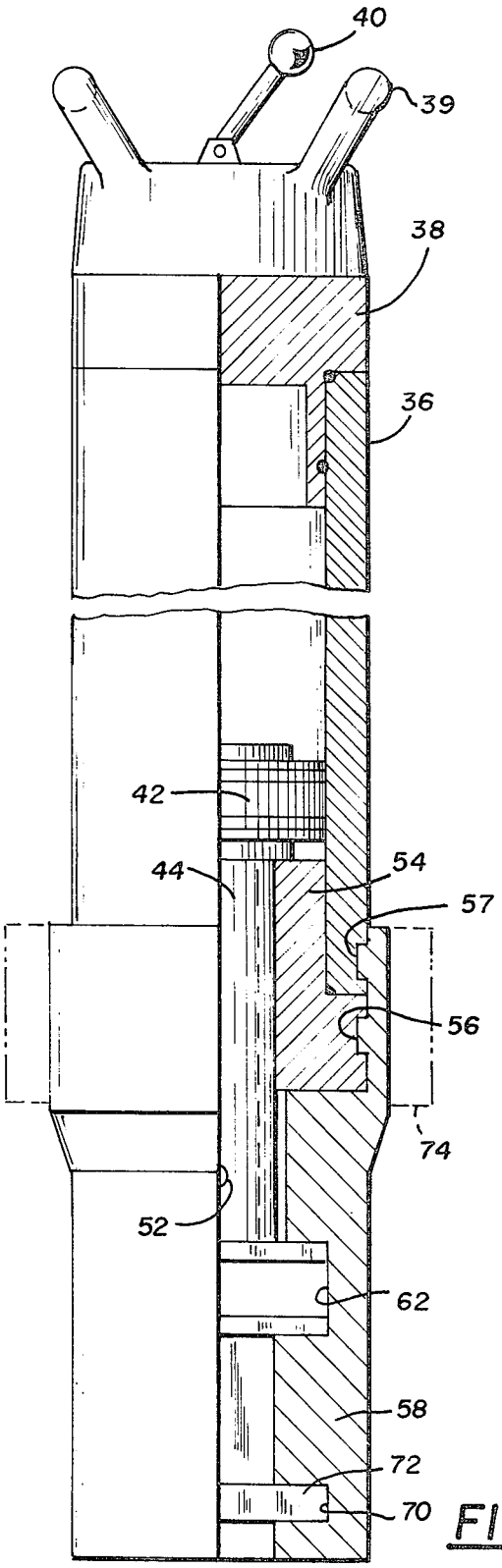
FIG. 1 represents a side view, partly in section, and showing a disassembling means for readily mounting and retaining a wedge and feathers used with a hydraulic cylinder used to move the wedge.
Figures 2, 3:
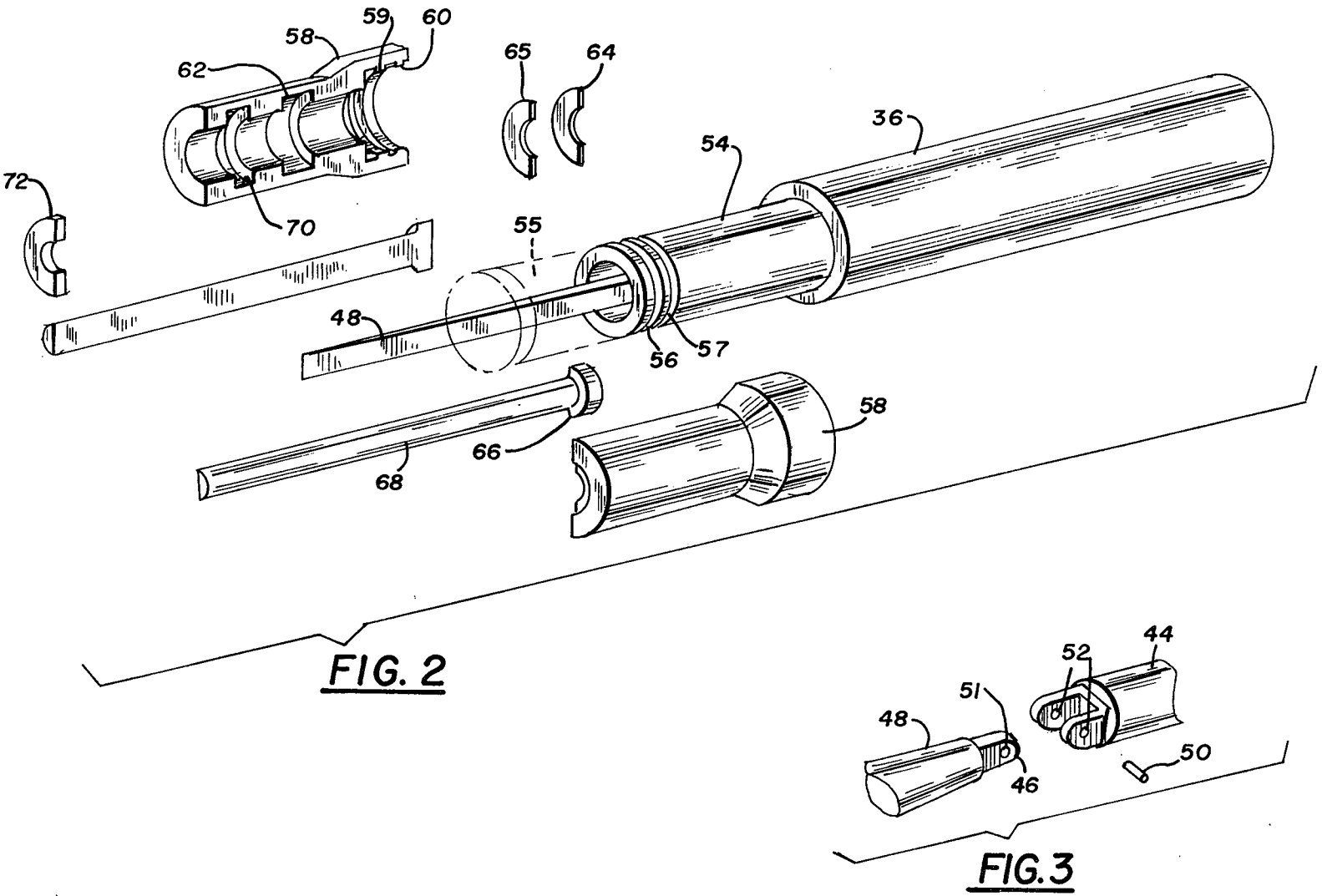
FIG. 2 represents an exploded, isometric view of the wedge and feathers and a split shell by which the feathers are retained in a desired orientation and relation to the wedge, this split shell mountable on grooves formed on the lower portion of the cylinder barrel.
FIG. 3 represents an exploded, isometric view fragmentarily showning the securing of a wedge to the lower end of the piston rod.

Referring now in particular to the drawings and FIGS. 1, 2 and 3, there is depicted a hydraulically actuated rock splitter in which the feathers are retained by clam shell clamp portions. An upper band 36 has a head end portion 38 which may include an integrally attached handle 39 and a control valve handle 40. A piston 42 has a rod end 44 which may be tubular to the extent that a seating and receiving portion is provided for a large retaining end 46 of a taper wedge member 48. A pin 50 is used to hold wedge member 48 in rod end 44. This pin passes through aligned holes 51 and 52 in the wedge and piston rod end and is easily inserted when the piston rod is moved to a forward position. The pin is preferably retained by a spring plunger member carried in the wedge end 46 and a retaining groove 53 formed in pin 50. The piston rod end 44 is slidably retained in a socket found in a rod end member 44. Where and when a lower housing is to be provided as a part of a new assembly, the housing does not need an extension to guide the piston rod as it is moved forwardly.

Figure 6:
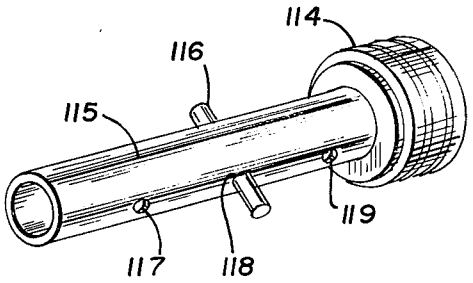
FIG. 6 represents an isometric view of a piston and rod end and showing length adjusting means formed in the rod portion.

A conversion or alteration may use portions of items 41 and 42 as shown in FIG. 6 of DARDA, U.S. Pat. No. 3,414,328 instead of the housing member 54 of FIG. 1 of this application. If the unit as shown in DARDA is to be converted, then that portion of member 41 below sleeve 42 of FIG. 6 in U.S. Pat. No. 3,414,328 is cut off and discarded. This cut off portion is indicated in FIG. 2 of this application as 55 and is shown in phantom outline.

In either the housing member 54 of FIG. 2 or in the combined housing 54 and 36 of FIG. 1 of this invention, it is contemplated that two grooves 56 and 57 are formed into the outer surface of this lower housing. A clam shell clamp of substantially like halves 58 has inwardly directed rib members 59 and 60 which are spaced and sized to be a snug fit in the grooves 56 and 57. In the forward end of these clam shell clamp member halves 58 is an enlarged recess 62 in which upper and lower wear plates 64 and 65 are retained. These wear plates are positioned on each side of an enlarged, outwardly extending, end portion 66 of one of a pair of like feathers 68. Shown also in clam shell clamp member 58 is groove recess 70 for retaining a rubber washer 72 which provides a dust stop or shield.

Wear plates 64 and 65 may be identically formed pieces die cut from sheet metal material. These pieces may be complete washers in which case member 64, as a washer, is slid up wedge 48 first. The feather pairs 68 are then brought next to the wedge, and washer 65 is slid up the shank of the two feathers. Rubber dust stop 72 may be a full washer which is slid into place over the feathers 68 after assembling or may be two half members as shown in FIG. 2. When wear plates 64 and 65 are made as half washers, they are placed in clam shell members 58 in the recess 62. In a like manner, dust stop or shield 72 is mounted in groove recess 70 formed in each clam shell half 58. As and when assembled, with the various components mounted therein, the clam shell members 58 are secured in a tight condition to the grooved barrel 36 and rod end member 59, or to the rod end member 54 of FIG. 2, by a strap clamp 74 shown in phantom outline in FIG. 1.

This strap clamp may be any conventional unit which permits infinite adjustment. Also contemplated is a hinge and pin with a screw or pin-type closure. What is contemplated and desired is a clamp that is readily opened by conventional means such as finger manipulation, a screwdriver or plier. Such a clamp retainer allows the clam shell halves 58 to be opened and the wear plates, the wedge, the feathers, the dust stop and the clam shell portions to be readily inspected for wear and damage sufficient to require replacement. Rather than a screwed together assembly requiring a precise fitting of upper and lower barrels and a comparable fitting of the wedge and feathers, the lower portions retained by the clam shell halves require no precise fitting.

The lower portion including the wedge, feathers, wear plates and the dust shield may be exposed for an inspection, replacement and/or repair as required.

EMBODIMENT OF FIG. 4

Figure 4:
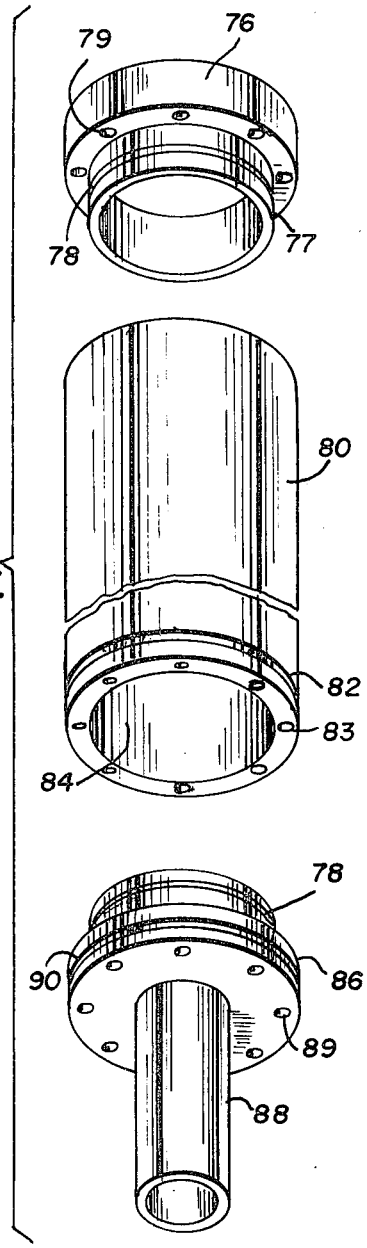
FIG. 4 represents an exploded, isometric view of an improved cylinder construction with head and rod ends secured by bolts and threaded apertures.

In FIG. 4 there is shown an alternate embodiment of a piston barrel in which an upper end closure member 76 is provided with a reduced portion in which is mounted O-rings 77 and 78 which are maintained in a snug fit and are suitably compressed when inserted into the interior and end of the barrel. Apertures 79 are arranged in a determined array in the larger portion of this end closure. These apertures provide for carrying and then insertion into the tapped holes in barrel 80. Barrel 80 is preferably a piece of tubing of determined wall thickness with an exterior groove 82 formed in the lower portion of this barrel. Tapped holes 83 are formed in this visible end and these tapped holes are similar to tapped holes or threaded holes not shown in the other end of the barrel. The interior 84 of the barrel is smooth finished for the accommodating of a piston, to be hereinafter described. A lower rod retaining end 86 has an extending guide portion 88, if desired. Into the enlarged portion of this lower rod end retainer is formed a plurality of holes or apertures 89 through which pass cap screws or bolts, not shown. Also formed in the lower end retaining member 86 is groove 90 which, when the retaining member is secured in position, provides with groove 82, formed in the barrel, a pair of spaced apart grooves in which ribs from the clam shell member may be mounted to provide the desired spacing and mounting of the clam shell half, as above-described. Shown as mounted in the lower retaining member 86 is an O-ring 78. Other O-rings may be mounted to provide the desired high pressure sealing of this lower retaining member in the barrel.

MODIFICATIONS AS SEEN IN FIGS. 5, 5A, 5B, 5C AND 6

Figure 5:
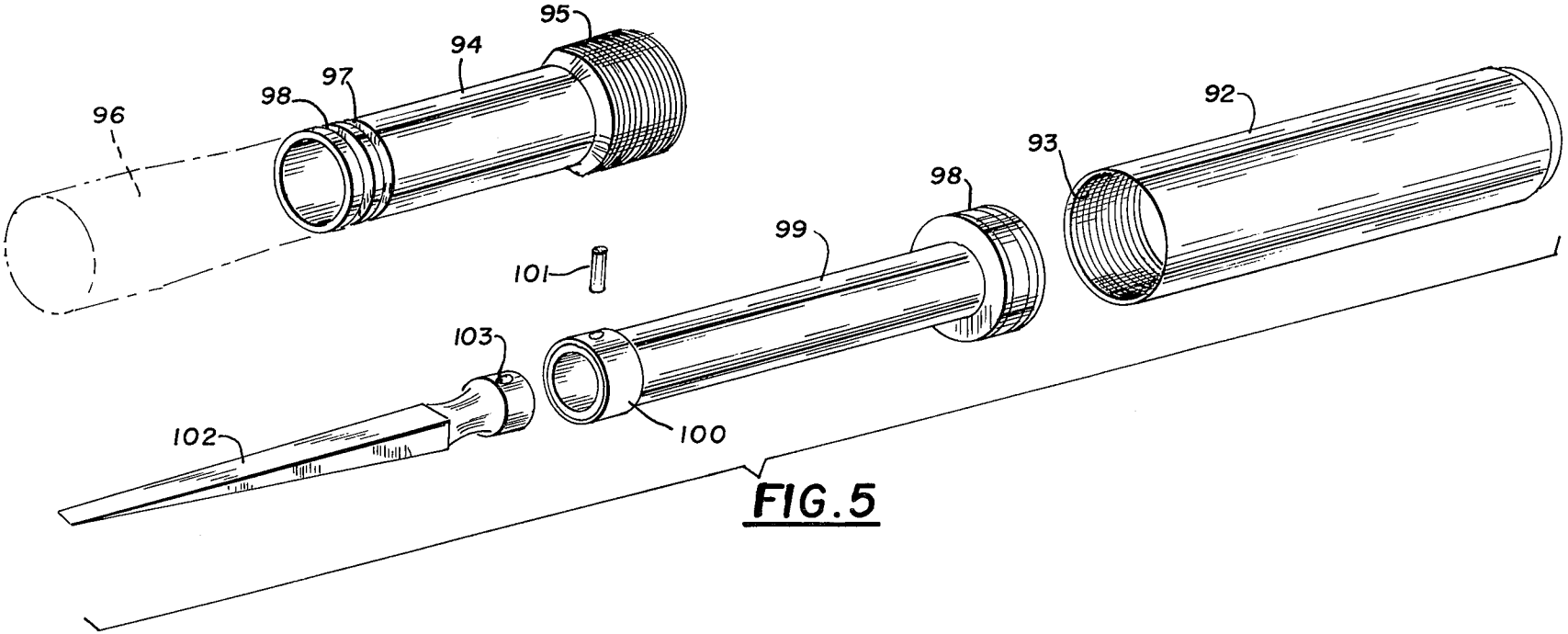
FIG. 5 represents an exploded, isometric view of a conversion of a rock splitting apparatus in which the feathers or presser cheek members are mounted from the side into a threaded in-place housing.

Referring now to the drawings and in particular to FIGS. 5, 5A, 5B, 5C and 6, it is to be noted that as depicted in FIG. 5 a modification of the Model 8 DARDA apparatus is shown. This apparatus is particularly described and shown in U.S. Pat. No. 3,957,309 issuing May 18, 1976. In particular attention is directed to FIGS. 5, 6 and 7 of said patent. In the modification shown in FIG. 5 of this application an upper cylinder shell 92 has a lower threaded end 93 into which is screwed a lower cylinder shell 94 having a threaded end 95 which mates with and is seated in threaded portion 93 of shell 92. The lower portion of this shell 94 in the DARDA Model 8 contains the feather locking pins, springs, wear plates and the like. This portion is often damaged in use and, therefore, it is cut off at a selected point above the feather retaining portion. This portion 15 indicated in phantom outline and identified as 96 after separation is discarded. Formed in this remaining lower shell 94 are grooves 97 and 98 which provide mounting means for clam shell halves, as above described. A piston 98 having a lower rod end 99 is conventional in construction. A reinforcement of the hollow tubing rod end is a collar member 100 in which a transverse hole is formed in this collar portion and end portion. This hole is sized for the snug retaining of pin 101. A wedge 102 is similar to or may be utilized from the DARDA device and has a hole 103 formed in this end for the attachment of this wedge to the rod end 106 by means of pin 101.

CONVERSION AS IN FIGS. 5A, 5B AND 5C

Figure 5A:
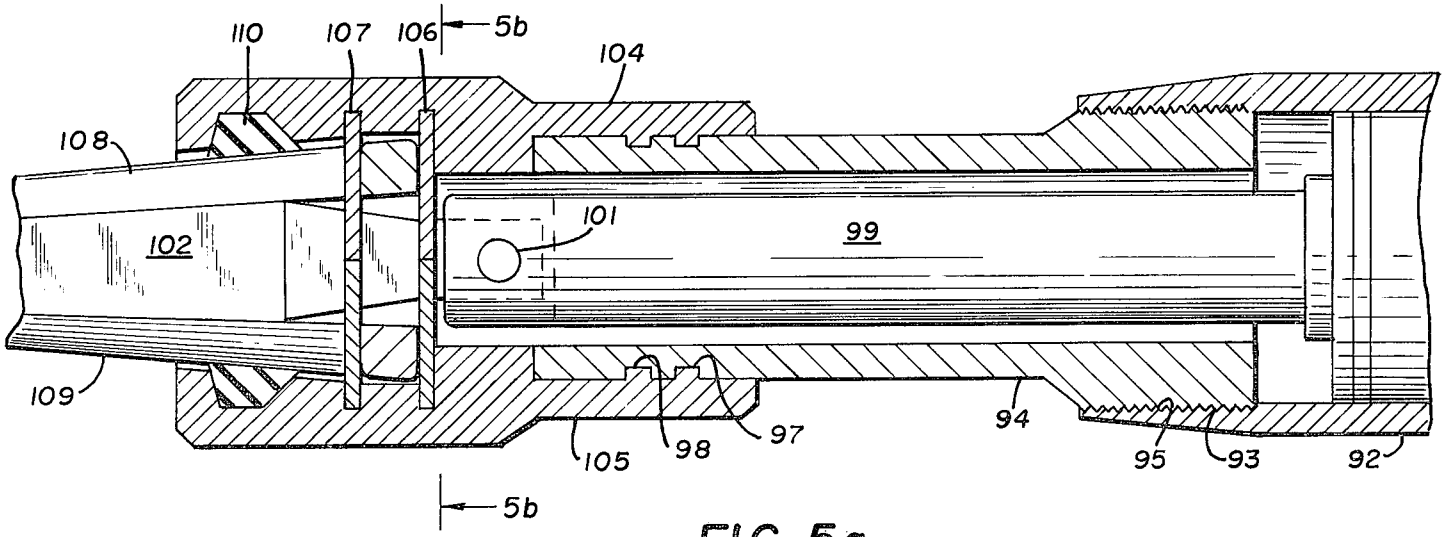
FIGS. 5A, 5B and 5C represent a side, end and plan view showing in enlarged scale the conversion provided by the apparatus of FIG. 5.
Figure 5C:
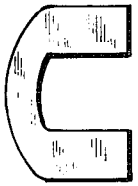
Figure 5B:
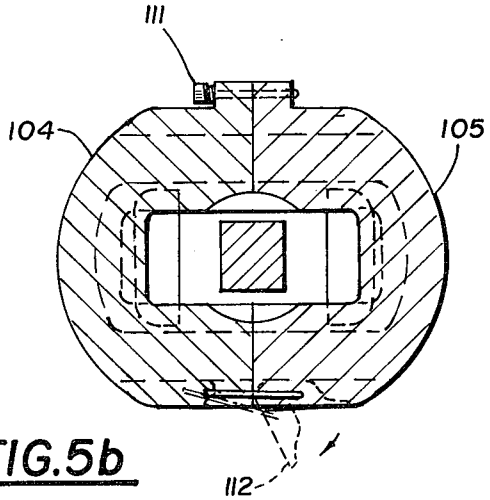

Referring next to FIGS. 5A, 5B and 5C, there is shown in enlarged scale and greater detail a conversion whereby a damaged DARDA Model 8 may be salvaged at least to the extent of a continued use of the hydraulic cylinder and a portion of the lower barrel. This lower cut off barrel portion 94 which remains after cutting has grooves 97 and 98 formed in its exterior surface. The portion 94, after cutting to the desired length, is mounted in shell 92 by threads 93 and 95. Wedge 102 is secured to rod end 99 by pin 101.

Clam shell halves 104 and 105 are preferably of like construction and configuration and, as reduced to practice, are finished castings. Grooves are formed to retain wear washers 106 and 107 which preferably and like, horseshoe-shaped members. Four like washer halves are used to provide the desired conversion. Feathers 108 and 109 are like units and at their upper ends are retained by the wear washers 106 and 107 and the clam shell halves 104 and 105. A resilient gasket 110 is retained in a groove formed in the clam shell halves. Gasket 110 is usually a half washer or rubber.

Referring to FIG. 5B, it is to be noted that clam shell halves 104 and 105, as assembled, are ovoid in shape. Quick release clamp members are depicted. Turn hooks 111 may be provided or toggle clips 112 may be used to secure the clam shell halves together. Of course, screws or any other conventional clamping means may be used.

In FIG. 5C wear washers 106 and 107 are depicted in a horseshoe configuration with the elongated form showing an allowance for the transverse movement of the feathers. Outward movement is provided by the wedge and inward movement by the rubber gasket 110.

ROD END CONNECTION AS IN FIG. 6

In FIG. 6 is shown a piston 114 having a rod end 115 in which transverse pins 116 may be selectively mounted in a plurality of holes 117, 118 and 119 so that the return movement of the wedge may be restricted. Pin 116 is utilized to limit the return movement of the piston in the barrel. The forward end of the rod end is attached to the wedge so that the restricted stroke of the piston may be translated to the wedge action which may be three, four, five or more inches.

PISTON STROKE ADJUSTMENT AS IN FIG. 7

Figure 7:
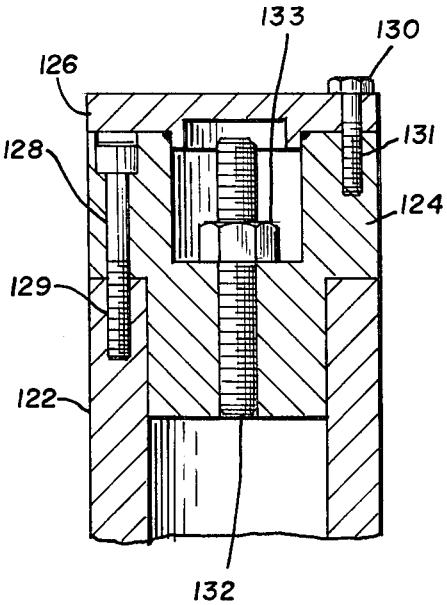
FIG. 7 represents a fragmentary side sectional view of a cylinder upper or closed end with an adjustable screw which may be moved to a stop position to limit the return stroke position of the piston.

Referring next to FIG. 7, there is depicted a method and means by which the rear stroke of the piston may be adjusted. In an upper barrel 122 there is mounted a head end piece 124 which is additionally closed by a cap member 126. This head end member 124 is retained in the upper barrel 122 by means of cap screws 128 passing through and mounted in countersunk apertures formed in member 124 and in threaded holes 129 in the upper portion of barrel 122. In a like manner, cap member 126 is retained to head end member 124 by means of cap screws 130 which pass through apertures in the cap member 126 and into threaded holes 131 in member 124. An adjusting screw 132 is carried in a through-threaded aperture in head end member 124 and is retained in the adjusted position by means of a hex nut 133.

In use and assembly the head end member 124 is mounted in upper barrel 122 and is tightened in position by means of cap screws 128 which pass through the counterbored holes in member 124 and into threaded holes 129 in the upper barrel 122. Gaskets or O-rings, although not shown, accommodate the high pressure fluid in the barrel. These gaskets are provided so that no leak may occur, or no passage of hydraulic fluid in the barrel under the extreme high pressure will flow from the barrel through the space between the members 122 and 124. As it is very difficult to form threads in member 124 and mounted screw 132 so as to retain a high pressure flow from escaping past these threads, a cap member 126 is provided. This cap member also has a gasket or other sealing means whereby when it is tightened in position by means of cap screws 130 any fluid that escapes past the adjusting screw 132 is retained in the recess in which the nut 133 is mounted. This cap member 126 thus prevents an escape of the fluid from the interior of the piston. Nut 133 is loosened when and while the screw 132 is advanced forwardly to provide a stop which engages the end of the piston movable in upper barrel 122.

LOWER PISTON STOP AS PROVIDED IN FIG. 8

Figure 8:
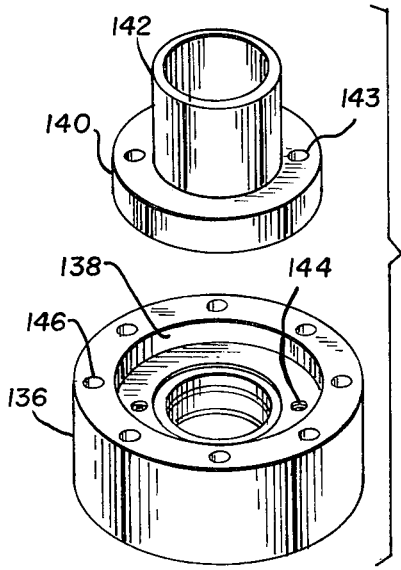
FIG. 8 represents a fragmentary, isometric view of a rod end closure member for a hydraulic cylinder and a stop member to limit the forward motion of a piston.

Referring next to FIG. 8, it is to be noted that a stop for the advancement of the piston may be provided by means of a collar member. As shown in FIG. 8, closure member 136 is formed with a recess 138 in which is mounted the flange end 140 of the piston stop. This flange portion 140 is adapted to carry a piston stop which includes a tubular portion 142 which is of a selected length and in a mounted condition establishes a forward position for the piston travel. A pair of apertures 143 are adapted to carry a pair of screws, not shown, whose threaded ends enter into threaded holes 144 in the rod end closure member 136. Apertures 146 formed in member 136 are adapted for screws that mount this rod end 136 to an upper barrel 80, as seen in FIG. 4. In mounted condition, the flange portion 140 is seated into recess 138 and affixed by screws entering through apertures 143 into holes 144. The sleeve portion 142 is slid over the rod end of the piston and then the enclosure 136 is brought into position with bolts, not shown, passing through apertures 146 into threaded holes in the upper barrel. In this manner the sleeve extension 142 restricts the forward travel of the piston as it moves in the barrel.

PISTON MOVEMENT RESTRICTOR AS SEEN IN FIG. 9

Figure 9:
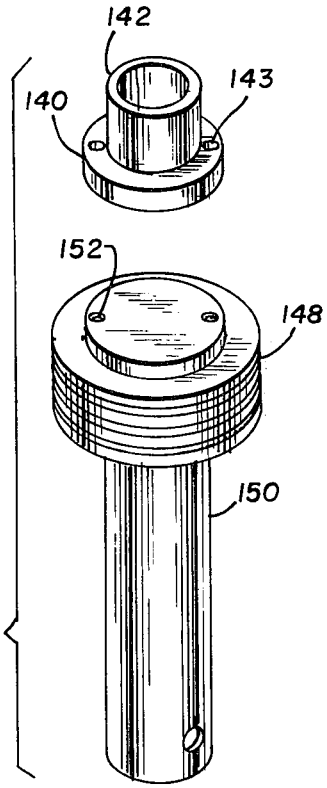
FIG. 9 represents a fragmentary, isometric view of a piston with a member which may be attached to the head end of the piston to limit the movement toward the closed end.

Referring next to FIG. 9, it is to be noted that a piston 148 having a rod extension portion 150 has affixed to the upper surface of this piston the motion restrictor 140 of FIG. 8. The flange portion 140 has the upper tubular stop portion 142 extending away from the end of the piston 148. The holes 143 provided in this restricting member mate with holes 152 formed in the top surface of the piston 148. Cap screws, not shown, pass through the two apertures 143 and into threaded holes 152 to secure this movement restrictor to the upper portion of the piston. In an assembled condition, the restrictor limits the motion of the piston toward the head end of the cylinder and this amount of travel restriction is equivalent to the thickness of the flange 140 and the extending portion 142.

PISTON TRAVEL RESTRICTOR AS SEEN IN FIG. 10

Figure 10:
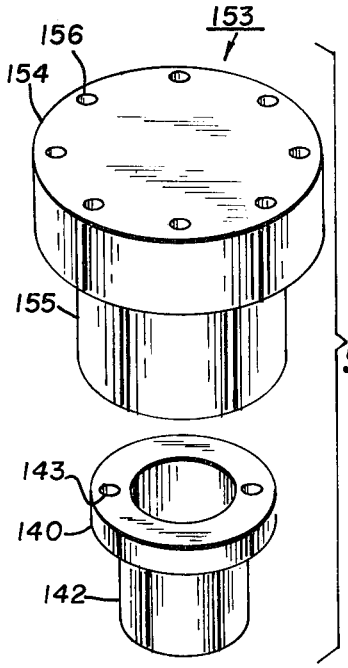
FIG. 10 represents a fragmentary, isometric view of a closed head end of a cylinder and with a piston stroke limiting stop carried by this head end.

Referring now to FIG. 10, it is to be noted that the restrictor 140, instead of being secured to the piston, may be secured to a head-end member 154. This head-end member 154 has a reduced end portion 155 which is mounted in the barrel portion, as seen in FIG. 4. Apertures 156 are provided so that cap screws, not shown, may pass through these apertures and into threaded mating holes formed in the barrel. Restrictor 140 is turned so that extending end 142 is directed toward the piston. A pair of threaded holes, not shown, mate with apertures 143 so that restrictor 140 may be mounted to the head end member 154 by screws, not shown.

In an assembled condition, the restrictor 140 limits the travel of the piston toward the head end member 154. This amount of restriction is selected by the extending length of tubular stop 142.

FEATHER MOUNTING APPARATUS OF FIGS. 11, 12, 13 AND 14

Still referring to the drawings and in particular to FIGS. 11, 12, 13 and 14, there is provided means for physically retaining the upper ends of the feathers by means of pins passing through enlarged portions of these feathers. In U.S. Pat. No. 3,995,906 there are shown several means by which pins are inserted and carried in the lower barrel to retain the upper ends of these feathers by engaging notches formed in the feathers. These notches are enlarged sufficiently for the feathers to swing outwardly as urged by the forward or downward movement of the wedge. Transverse shafts are mounted in opposite sides of the head and engage each pressure cheek to suspend the pressure cheeks so they are locked against axial movement. These pins and grooves permit limited transverse movement.

In the present application there is shown apparatus in which pins pass through holes or apertures formed in the upper end of the feathers (pressure cheeks) to pivotally retain these feathers in a retained condition. As seen particularly in FIG. 11, the upper end of feathers 160 and 161 have enlarged head portions. Between these feathers is disposed a tapered wedge 162 of a conventional construction adapted to pass and urge the feathers outwardly. Pins 163 and 164 engage and retain the upper ends of these feathers in retained position in a clam shell end as above-described. Pins 163 and 164 pass through elongated holes 165 and 166 formed in the upper ends of these feathers and retain these feathers in longitudinal condition as far as the wedge is concerned. The elongated holes permit the feathers to move inwardly and outwardly according to the taper on the wedge. A rubber bumper or washer device, not shown, is adapted to urge the feathers to an inner condition or position.

Figure 13:
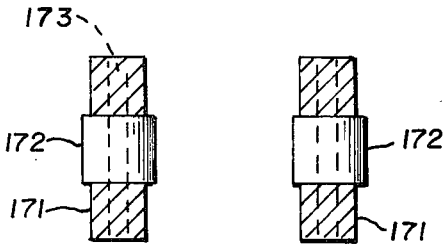
FIG. 13 represents a plan view, showing in section the collar and feathers of FIG. 12, this view taken on the line 13—13 of FIG. 12 and looking in the direction of the arrows.
Figure 12:
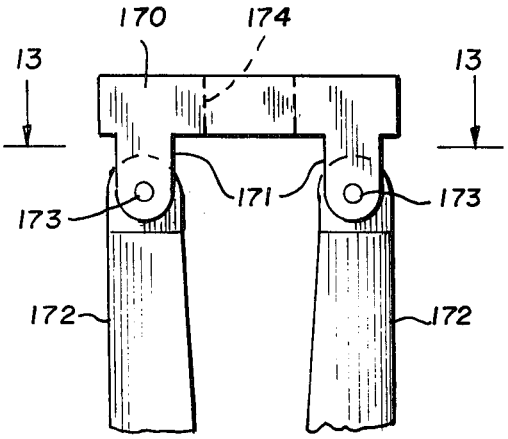
FIG. 12 represents a side view, partly diagrammatic, of a retaining collar and a pair of pivotally retained feathers.

Referring next to FIGS. 12 and 13, it is to be noted that a collar member 170 may have pivot portions 171 extending downwardly therefrom. Between these end portions 171 feathers 172 are pivotally retained by means of pins 173. The feathers 172 are reversed to retain their flat, internal construction and their outer, circular construction. After mounting the feather by the pins 173, the retaining ring 170 may be retained by the clam shell halves as previously discussed with a groove formed to retain the shoulder portion of ring 170. An aperture 174 is formed in the central portion of the ring member 170 to allow the wedge to pass therethrough.

As seen in FIG. 13, the hinge portions of the member 170 are formed as two downwardly extending portions to position and retain the center portion of the feather 172. If desired, this hinge arrangement may be reversed to form a three-part hinge attachment with the feather forming the outer part of a three-part arrangement.

Figure 14:
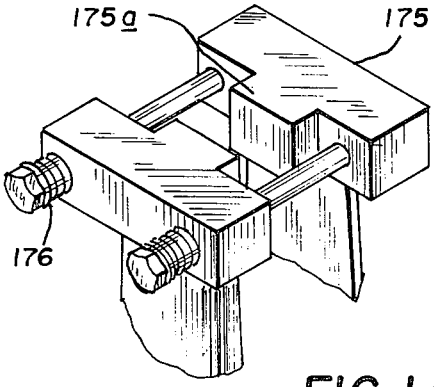
FIG. 14 represents an isometric view of an alternate method of securing the ends of the feathers by pins.

In FIG. 14 there is depicted a feather supporting and securing arrangement wherein like feathers 175 have two holes formed in their upper ends in which like bolts 176 pass through for mounting in holes in a lower retainer, not shown. Pad portions **175*a*** may be provided on the feathers to provide a guide for the wedge as it moves therebetween.

Figure 11:
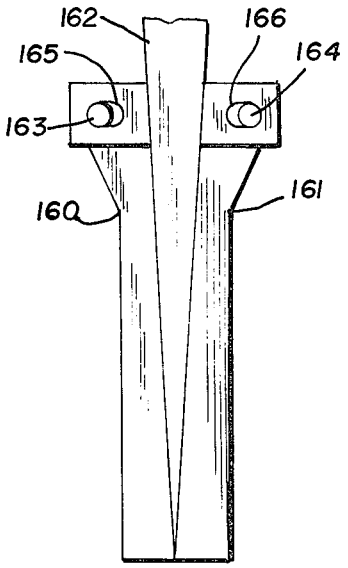
FIG. 11 represents a side view, partly diagrammatic, of a wedge and feathers in which the pins holding the ends of the feathers are retained in the clam shell retaining halves and in the ends of the feathers are formed slots allowing the feathers to move outwardly with the movement of a wedge.

Whether the feather supporting means is arranged as in FIGS. 11, 12 and 13 or as in FIG. 14, these embodiments show the feathers having holes in which bolts or pins pass to secure the feathers in the lower housing. The embodiments of FIGS. 11, 12 and 13 are arranged for the feathers to pivot on the retaining pin members. FIG. 14 shows the feathers secured by pins which pass through both feathers. The pins or bolts are made sufficiently loose to permit movement to and away from the moving wedge. Rubber rings that are stretched as the wedge urges the feathers apart may be employed to maintain the feathers against the tapering surfaces of the wedge.

WEAR RETAINING MEANS AS SHOWN IN FIG. 15

Figure 15:
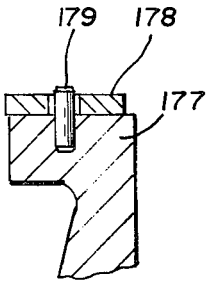
FIG. 15 represents a fragmentary, sectional view of an enlarged end of a feather and a means of locating and securing a wear plate portion to the top of a feather.

Referring next to FIG. 15, it is to be noted that a feather 177 is adapted to hold a wear washer 178 in the fixed position on the top end or the thrust surface of the feather by means of pin 179. This pin is pressed into an aperture formed in the feather 177. Wear Washer 178 is thus held in position during insertion into a clam shell half.

HOLDING OF LOWER WEAR WASHER AS IN FIG. 16

Figure 16:
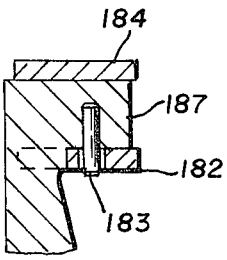
FIG. 16 represents a fragmentary sectional view of an enlarged end of a feather and a pin means for positioning and securing a wear plate portion to the lower portions of the feather protrusion.

Referring now to FIG. 16, it is to be noted that feather 181 may hold a lower wear washer 182 by means of a pin 183. This pin is a press fit into an aperture formed in the enlarged end of feather 181. If desired, the upper wear washer 184 may also be held by a pin as in FIG. 15. If such is the desire, these pins may be a press fit into the feathers and the washers may be a slide fit onto these pins and then be retained by the grooves formed in a clam shell half.

WEAR PLATE MOUNTING OF FIG. 17

Figure 17:
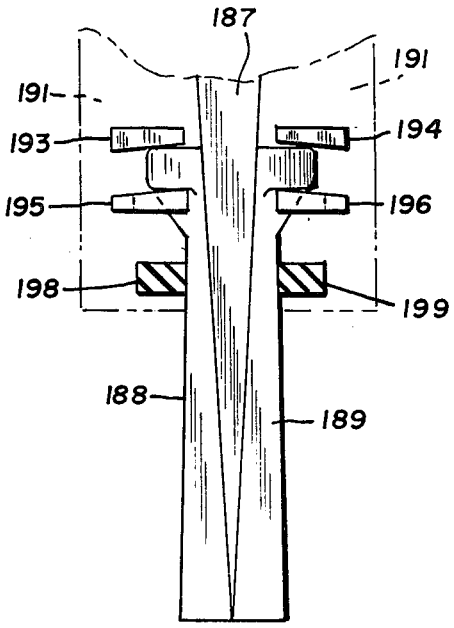
FIG. 17 represents a side view, partly diagrammatic and fragmentary, and showing a wedge, two feathers, a curved upper wear plate, a curved lower wear plate and clam shell retaining clamp members to hold these portions.

Referring next to FIG. 17, there is to be seen a wedge 187 arranged between feathers 188 and 189. Clam shell halves 191 are shown in phantom outline and retain upper wear plates or washers 193 in groove 194 and lower wear or washer plates 195 in groove 196. A rubber ring or compression member 198 is retained in a groove 199 formed in this clam shell member 191. In an assembly of these components the wedge 187 is secured to the rod end, not shown, and the clam shells 191 are brought to a lower barrel portion, not shown. Upper wear plates or washers 193 are curved slightly on their underside and are mounted in grooves 194. Wear plates or washers 195 are curved slightly on their upper side and are mounted in grooves 196. The clam shell halves 191 are then brought together with rubber washer 198 fitted in place. The various components are positioned and retained in the grooves provided in the clam shell. Retaining of the clam shell halves may be by means of an outer exterior clamp or may be by means of other fastening devices as above shown.

ALTERNATE EMBODIMENT OF FIG. 18

Figure 18:
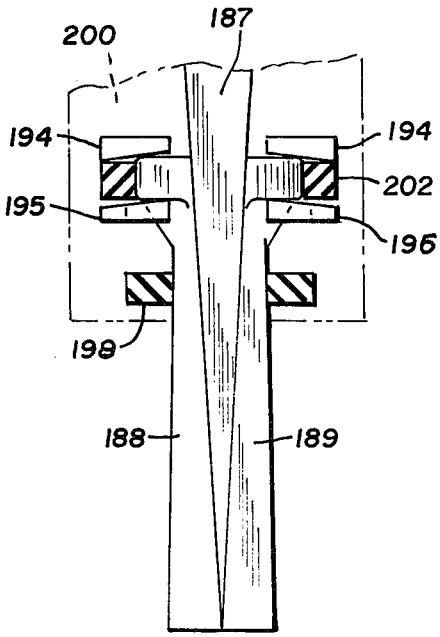
FIG. 18 represents a side view such as in FIG. 17 but with a resilient ring member to hold the upper end of the feathers against the wedge as it is moved.

Referring next to FIG. 18, it is to be noted that similar to FIG. 17 a wedge 187 is adapted to push two feathers 188 and 189 apart. When advanced therebetween, these feathers 188 and 189 are retained by clam shell member 200 which is much like clam shell 191 but instead of having grooves to retain the upper and lower wear plates has a recess in which upper wear plate 193 and 194 and lower wear plates 195 and 196 are mounted. Between these wear plates is disposed a rubber ring 202 which may be a split member of two halves or may be a solid ring-like member. This ring is brought into place before the lower wear plates 195 and 196 are brought into position. A dust or retaining member 198 is also carried in a groove 199 formed in this clam shell half.

As in FIG. 17, the assembly of FIG. 18 is retained by means of the clam shell halves 200 and the rubber member 202 maintains the washer wear plates 193, 194, 195 and 196 in the spaced apart condition and adjacent the upper outwardly extending portion of the feathers 188 and 189. In a clamped together condition, the upper wear plates 193 and 194 are curved to present a curved lower surface for the upper end of the ear portion of the feather. In a like manner, the curved upper surface of the lower wear plates 195 and 196 also provide a curved surface for a rocking motion of the feathers.

WEDGE ASSEMBLY OF FIG. 19

As depicted, a tapered wedge 204 has a lower pin aperture 205 and an upper pin aperture 206. This pin aperture 206 is adapted to engage and retain a pin in a lower end of a piston rod, as above described. A collar member 207 has a rectangular aperture 208 which is made to slidably mount on the upwardly end of wedge 204. This collar 207 has a threaded aperture into which is mounted a spring pin 209 to retain a lower retaining pin 210 which is inserted in aperture 211 in collar 207 and through hole 205 in the wedge 204. A groove in the pin 210 is engaged by the spring end of pin retainer 209 to retain collar 207 in the desired position.

This collar 207 as fastened on the wedge 204 prevents undue movement of the wedge and rod end back and forth in the clam shell after the clam shell has been clamped into position. The placing of this collar 207 on the upper end of wedge 204 is designed to limit movement of the wedge transverse of the axial position of the wedge to a limit movement of no more than one-eighth of an inch from the theoretical axis.

RETAINING MEANS AS SHOWN IN FIG. 20

Figure 19:
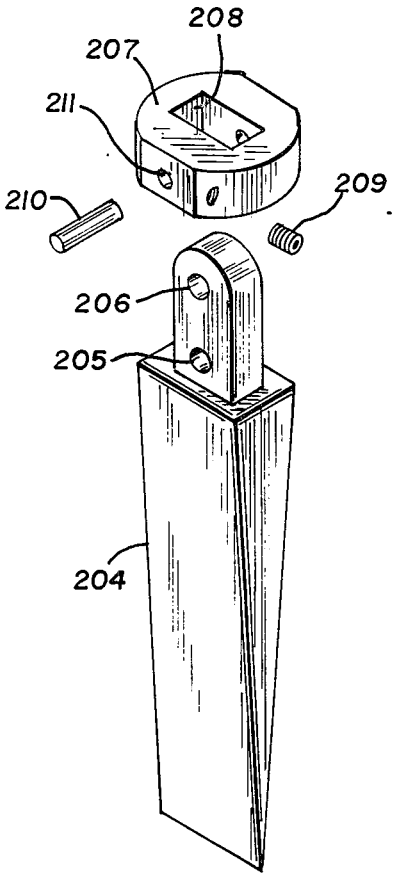
FIG. 19 represents an exploded isometric view of a wedge and guide collar which is adapted to limit the movement of the wedge in the clam shell clamp.
Figure 20:
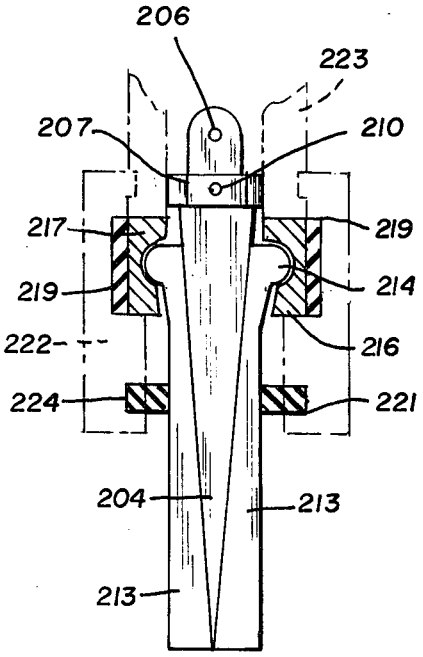
FIG. 20 represents a side view, partly in section, of the wedge and collar of FIG. 19 with the clamp adapted to retain socket sections by which the feathers are retained.

Referring next to FIG. 20, there is shown the wedge 204 of FIG. 19 and the collar 207 used therewith and retained by the pin 210. Like feathers 213 have upper outwardly extending ear portions 214 which may be a cylindrical form or may be partly spherical in configuration. No matter the shape, receiving socket members 216 and 217 are provided with their inner surfaces disposed to mate with and retain the extending ear portions 214 while permitting the feathers to be swung outwardly by the wedge advancement. A rubber ring 219 may be one or two pieces and is disposed around the outer periphery of socket members 216 and 217. A clam shell retainer or clam shell halves 221 and 222 have ring portions which mount in a groove in lower barrel 223. A rubber washer 224 is carried in a lower groove in the clam shell portions 221 and 222 and urges the feathers against the wedge.

As an assembly, the wedge 204 has collar 207 secured in place by pin 210. This assembly is then secured to a rod end by a pin through hole 206. Feathers 213 are positioned adjacent wedge 204 with the flat surfaces of the feathers against the tapered face of the wedge. Socket members 216 and 217 are next placed in position on the extending ear portions 214. Rubber ring 219 and washer 224 are positioned at the desired position and clam shell retaining halves 221 and 222 are brought into seating engagement of the lower barrel 223. A clamp, as above described, retains the halves to the lower barrel.

In operation, as the wedge 204 moves downwardly to move the feathers outwardly, both rubber rings 219 and 224 are sufficiently resilient to enable the desired outwardly expansion to occur. These rubber members also return the feathers to their in position when the wedge is returned to its "up" or start condition and position.

ROTATING PULSATING VALVE AS SEEN IN FIGS. 21 AND 22

Figure 21:
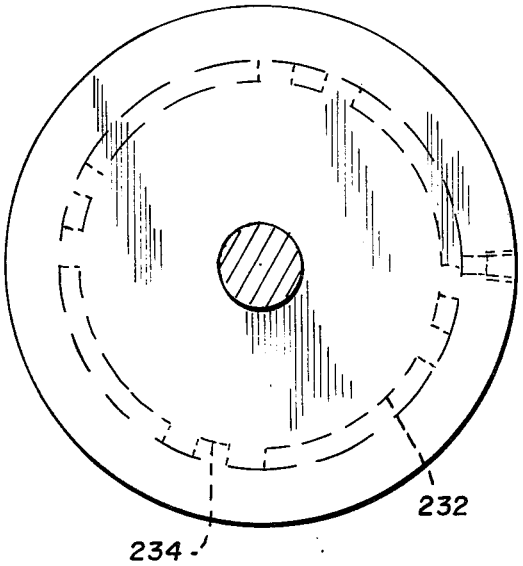
FIG. 21 represents an end view of a rotary valve by which controlled pulsations can be applied to the piston of the cylinder.
Figure 22:
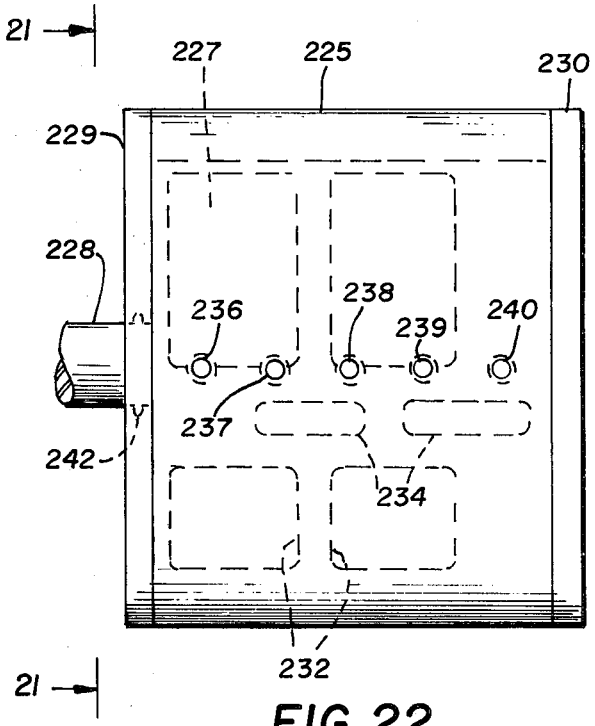
FIG. 22 represents a side view of the rotary valve of FIG. 21.

As shown in FIGS. 21 and 22, there is depicted a rotary valve which is adapted or designed to move high pressure fluid at approximately seventy-five percent of the time to an upper portion of the cylinder and about ten or fifteen percent of the time to a return stroke of a cylinder. This pulsation actuation of the wedge is designed to produce a forward movement of the wedge without an actual locking of the wedge between the sloped surfaces of the feathers. As shown, there is an outer housing 225 which is in essence a tubular member. Rotatable within close limits of the internal bore of housing 225 is a cylinder member 227 rotated at a determined speed by a shaft 228. This tubular member is closed at the ends by closure members 229 and 230. Four long pockets 232 are arranged in one peripheral row. An adjacent row of like pockets 232 are also formed in rotating member 227 and these pockets are approximately seven times as long as intermediate pockets 234 which are also formed in this valve. These elongated pockets, of which there are eight in the present embodiment, are alternately brought in way of inlet and outlet ports formed in the outer housing 225. From left to right, there are five ports numbered respectively 236, 237, 238, 239 and 240. An O-ring 242 is shown as a typical shaft seal against leakage of the fluid in the rotary valve.

In operation the valve may be rotated either clockwise or counterclockwise. The central port 238 is the high pressure inlet from the pump supply, not shown. Port 237 is connected to the rod end of the cylinder. Port 236 is connected to a return line to the pump. Port 239 is connected to the head end of the cylinder. Port 240 is connected to the return line to the pump.

As the cylinder member 227 is rotated, ports 237 and 239 are alternately fed high pressure fluid entering from port 238. During the longer period when the right-hand pocket 232 is in way of ports 238 and 239, high pressure fluid is conducted from port 239 to the head end of the cylinder to move the piston and wedge forwardly. The fluid on the rod end side of the piston, as the piston is moved, flows through the left pocket 232 and from port 236 to the recovery tank of the pump.

After pockets 232 have moved from in way of ports 236, 237, 238 and 239, a brief period occurs when all ports are closed after which the short pockets 234 are brought in way of ports 237, 238, 239 and 240. High pressure fluid from port 238 flows into the left pocket 234 and from port 237 to the rod end of the cylinder. At this same time, fluid in the head end of the cylinder flows from the cylinder to port 239 through the right-hand pocket 234 and from port 240 to the recovery tank of the pump.

The rotative action of the pulsation valve of FIGS. 21 and 22 assumes about a six or seven to one forward actuation, but the ratio may be changed to suit particular conditions. The high pressure flow to the cylinder and corresponding movement of the piston has a corresponding period of fluid return to the supply tank to accommodate a movement of the piston. A close fit of cylinder member 227 in the bore of tubular housing 225 is contemplated so as to minimize fluid transfer or flow from the high pressure supply to the return.

JACK HAMMER APPARATUS OF FIGS. 23, 24 AND 25

Figure 23:
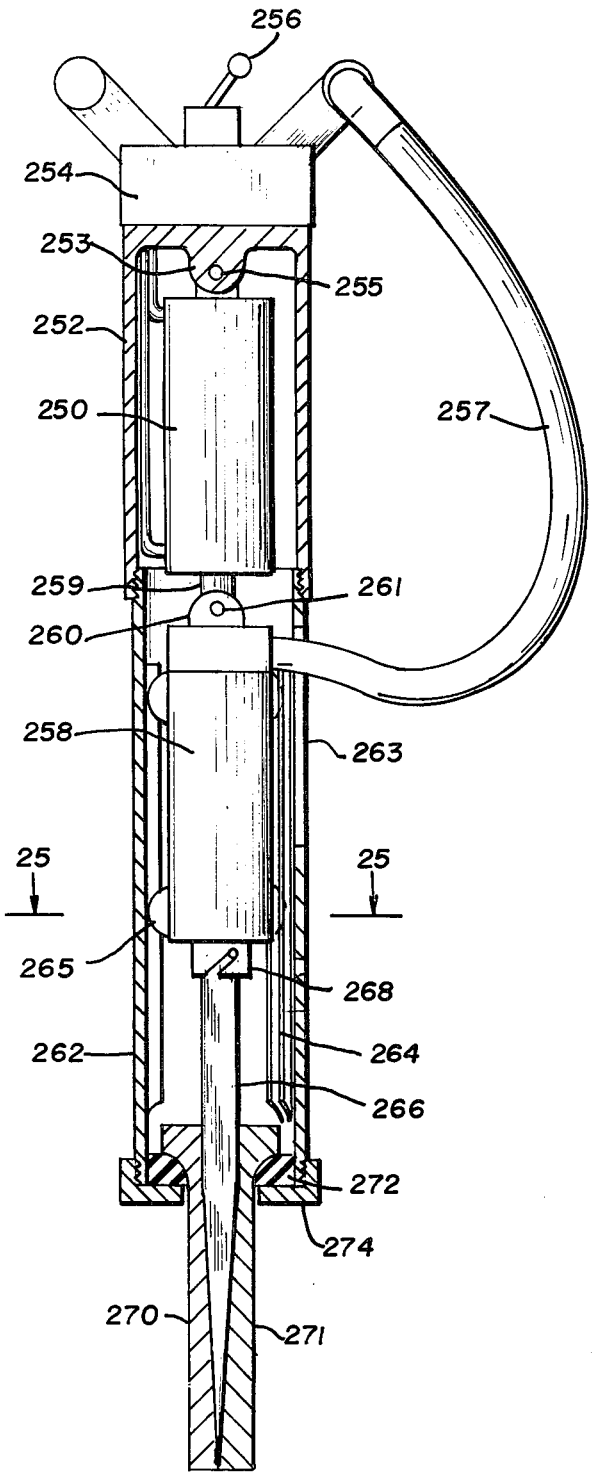
FIG. 23 represents a side view, partly in section and diagrammatic, and showing a wedge and feathers which are moved forwardly by a hydraulic cylinder and further actuated by a pneumatic cylinder carried forwardly of the hydraulic cylinder, the hydraulic cylinder being shown in a retracted position.
Figure 24:
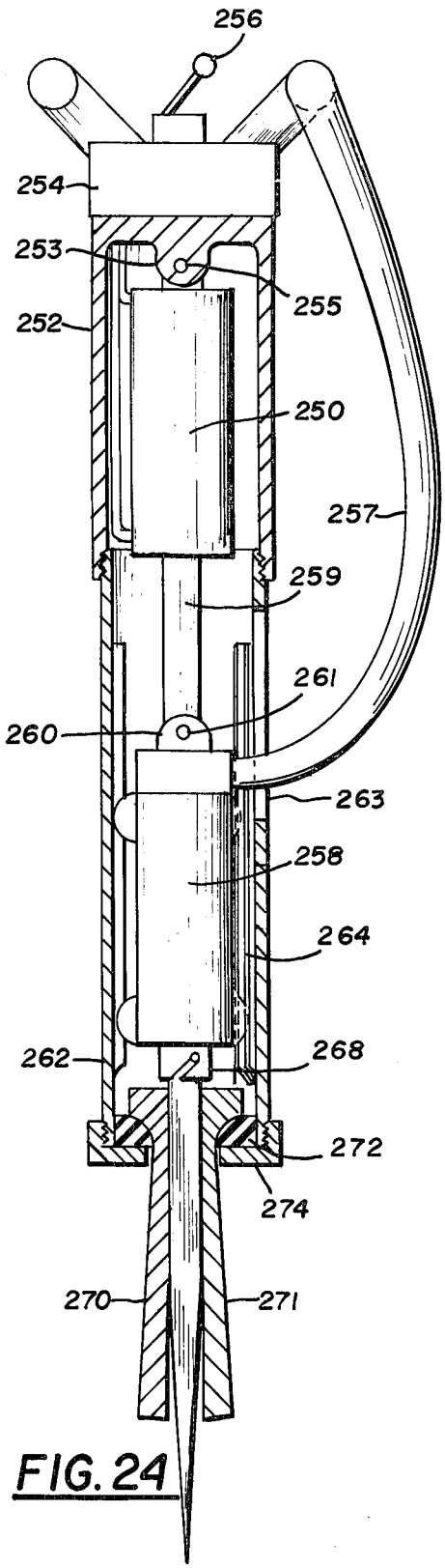
FIG. 24 represents the side view and assembly of FIG. 23 and showing the hydraulic cylinder in an expanded condition.
Figure 25:
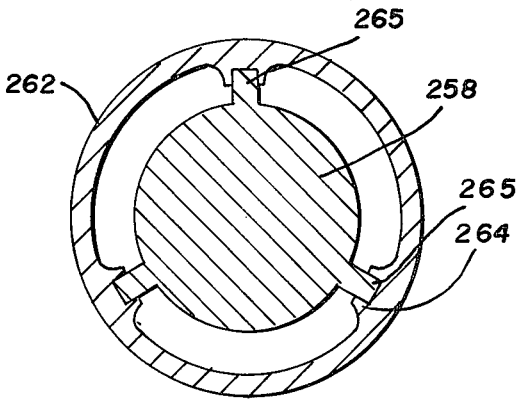
FIG. 25 represents in an enlarged scale a cross-sectional view taken on the line 25—25 of FIG. 23 and looking in the direction of the arrows and showing a slide guide means for the jack hammer apparatus.

Shown in FIGS. 23, 24 and 25 is an apparatus whereby a hydraulic cylinder 250 is carried in an upper housing 252 by means of a clevis end 253 formed in the head-end member 254 of this housing. A pin 255 retains the cylinder 250 in position as this cylinder is moved by means of a control valve actuated by control handle 256. An air line 257 leads from this head end 254 to an air cylinder 258 adapted to provide a pneumatic jack hammer action. This air cylinder 258 is moved forwardly by means of a rod end 259 carried by cylinder 250. This rod end mates with a clevis end 260 and is retained in this clevis end by means of a retaining pin 261. A lower housing 262 is mounted to the upper housing 252 by means of a thread. After mounting the hose 257 is passed through a slot 263.

In housing 262 is formed three equally spaced guideways 264 in which are carried wings 265 formed on and extending from the outer surface of lower cylinder 258. A wedge 266 is carried by a bayonet lock to the lower end of pneumatic vibrator 258. As this vibration is moved forwardly by the hydraulic cylinder 250, the wedge passes between feathers 270 and 271. These feathers have their enlarged portions engaged and supported by rubber collar 272 retained in place by means of a lower ring member 274 mounted on and to the lower housing 262.

In the feather expanded condition of FIG. 24, the cylinder 258 has been carried forwardly and downwardly in the guideways to achieve the fully expanded condition as seen in FIG. 24. In FIG. 25 an enlarged view shows a cross section of a vibrator cylinder 258 with the wings 265 as they move in the guideways 264 of the lower housing 262. In use and in operation, as the wedge and feathers are brought into a predrilled hole, the hydraulic cylinder 250 is advanced to cause the wedge to be brought forwardly and the feathers to be expanded outwardly to a tight condition in the hole. The vibrating action of the cylinder 262 is now actuated to cause a vibrational action to be additionally applied to the wedge 266. The wedge 266 is moved forwardly by the actuation of the hydraulic cylinder 250 which at the same time moves the pneumatic vibrator 258 forwardly in the guideways 264. As the wedge is moved forwardly, the feathers are moved apart and the vibrations induced by the pneumatic hammer member 258 are transmitted. This pulsation assists in reducing the coefficient of friction between the surfaces of the wedge and the feathers as the wedge moves the feathers in a rock splitting condition.

BAYONET LOCK AS IN FIG. 26

Figure 26:
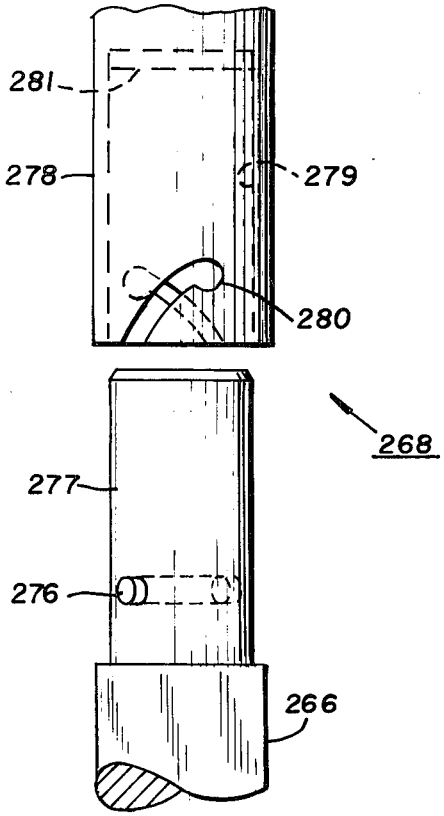
FIG. 26 represents in an enlarged scale a side view of a piston rod end and an attaching wedge or jack hammer bit, the attachment showing a bayonet locking means for securing the wedge to the rod end.

Referring now to the drawing and to FIG. 26, there is shown wedge 266 with a transverse pin 276 mounted in a reduced end of the wedge 277. This transverse pin protrudes to the extent necessary to form extending lug portions. A rod end 278 of a piston has a recess 279 formed therein. This recess is a slidable fit for the reduced end 277 of the wedge. In the lower portion of this rod end 278 are formed curved slots 280 which provide a bayonet lock of the wedge into the rod end. A rubber plug 281 may be provided at the upper end of recess 279 so that when the reduced end 277 is entered into the recess 279 and the pins 276 are caused to enter and turn in curved slot 280 the rubber plug urges the pins into a locked condition with pins 276 resting in the enlarged, inner, upper end of the curved slot to retain this wedge in the bayonet lock 268.

WEDGE AND FEATHER RETAINER OF FIGS. 27 AND 28

Figure 27:
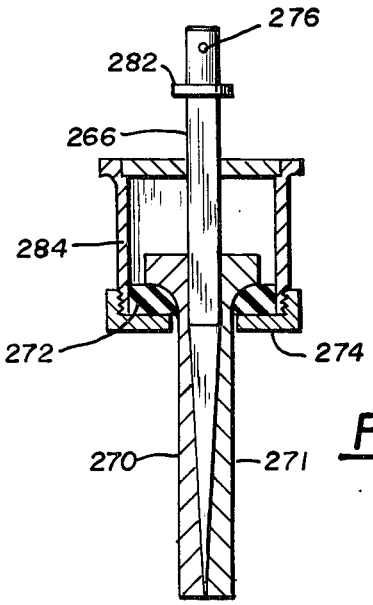
FIG. 27 represents a side view partly in section of a clamp-on wedge and feather end assembly.

In FIG. 27 is shown a removable wedge and feather retaining assembly in which a wedge 266 is adapted to move outwardly feathers 270 and 271 in a manner as above described. Wedge 266 has a pin 276 for attachment in the bayonet lock, above described, and a collar 282 affixed to the wedge to provide a stop, if desired. A housing 284 retains the feathers 270 and 271 and the rubber collar 272, which is retained in place by means of retaining ring 274.

Figure 28:
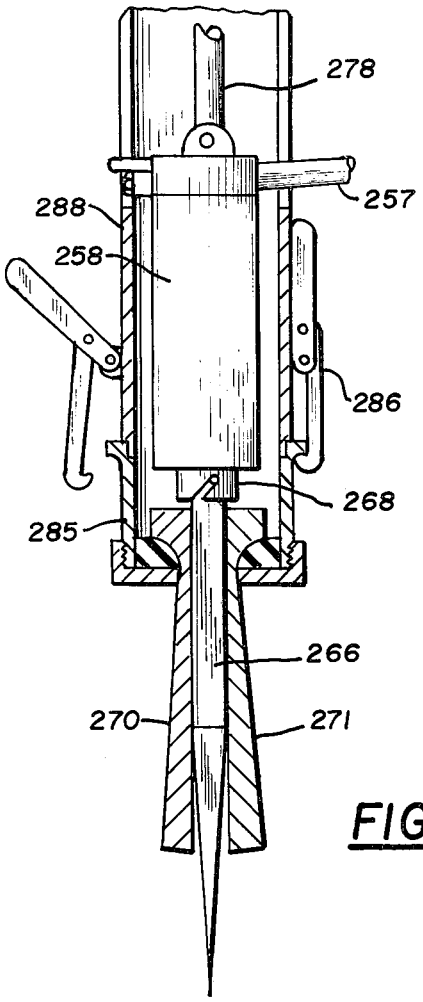
FIG. 28 represents a side view, partly in section and diagrammatic, and showing toggle clamp means for securing the wedge and feather assembly of FIG. 27 in the process of being clamped to the end of the jack hammer outer slide housing.

The housing 284 may be modified to the extent that the top closure or guide for the wedge may be removed so that when mounted in the apparatus, as shown in FIG. 28, the pneumatic vibrator 258 may enter into the housing 285. Toggle clamps 286, as seen in FIG. 28, may be fastened to the housing 288 in order to engage the outwardly extending flange portion of the housing 284 to retain this housing in the desired seated position on the end of housing 288. A shoulder is formed in housing 285 for mounting on the end of housing 288.

In use, it is anticipated that the clamps 286 may be released to allow the housing 285 and the wedge and feathers to be removed from the pin and bayonet lock 268. When a time for the replacement of this apparatus occurs, a wedge 266 is mounted into the bayonet lock 268 and with feathers 270 and 271 in place toggle clamps 286 are swung into position and locked in the upward condition to retain housing 285 and the components mounted therein. If the pneumatic vibrator 258 is not to be utilized, then clamps 286 may be mounted to the upper housing and the wedge 266 may be mounted in a rod end as in FIG. 26 to advance the wedge without the benefit of a pneumatic action.

HYDRAULIC ACTUATION AS IN FIG. 29

Figure 29:
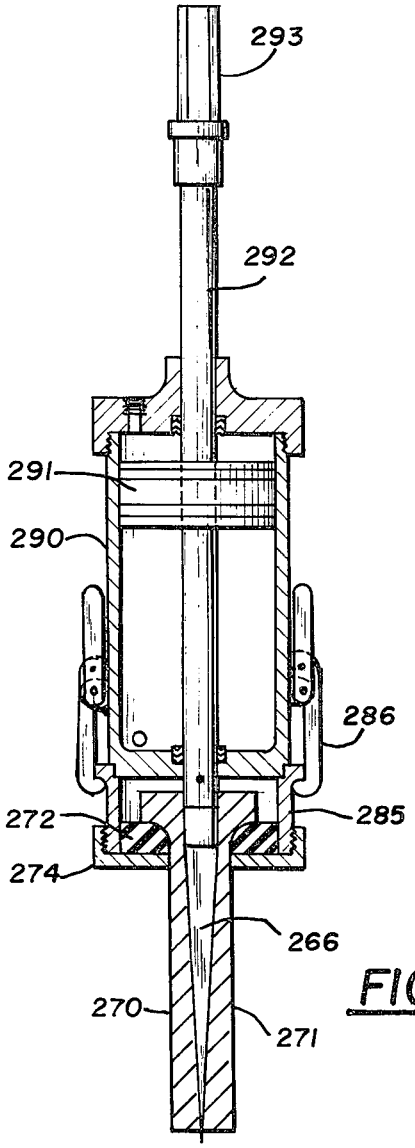
FIG. 29 represents a side view, partly in section and diagrammatic, of a hydraulic wedge actuating unit adapted for mounting in a jack hammer device.

In FIG. 29 there is shown a wedge 266 which is adapted to move feathers 270 and 271 outwardly. These feathers are retained by a housing 285, rubber collar 272 and a ring 274. Clamps 286 hold housing 285 to a piston barrel 290 within which piston 291 is movable. This piston carries the wedge forwardly with relation to the housing 290 and the attached housing 285. A piston rod 292 extends through the upper end of this piston housing and terminates with a hex end 293 which may be mounted and retained in a jack hammer of conventional construction.

In use, it is anticipated that this assembly will be housed in a jack hammer usually pneumatic in operation and that the hydraulic piston portion may then be utilized to urge the wedge 266 forward to expand the feathers 270 and 271 outwardly during the vibrating actuation of the jack hammer.

ATTACHMENT OF A DRILL BIT AS IN FIG. 30

Figure 30:
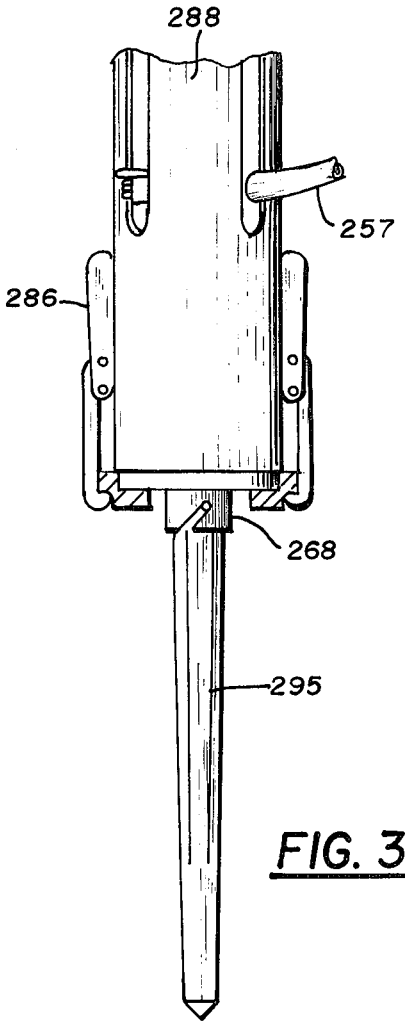
FIG. 30 represents the apparatus of FIG. 28 with a jack hammer bit toggle mounted and secured on the end of the piston rod rather than a wedge and feather assembly shown in FIG. 28.

Referring finally to FIG. 30, it is to be noted that on the housing 288 of FIG. 28 there may be secured as by clamps 286 a drill bit 295 which may be mounted by the bayonet lock 268. The pneumatic hammer is then actuated to cause the bit 295 to drill a hole in the conventional manner. The hydraulic cylinder 250 may be used to advance the drill bit 295.

This apparatus is described and shown in the drawings and particularly shows a clam shell preferably of like halves. These shell halves are retained by a strap or similarly effective clamp means. These removable clam shell portions may also be retained by pins rather than the groove and rings shown. One pin employed with each shell portion is all that is necessary to position and retain that portion to the lower housing and a strap clamp closes and retains the clam shell halves or portions in a selected position. The clam shell portions need not be of a clam shell concept but rather may be a clamped to the housing member. For this reason the claims define the retaining portions as a split clamp shell.

In the embodiments of FIGS. 23 thru 30, the feathers and/or drill bit contemplate that a pneumatic jack hammer or a jack hammer-type apparatus is used. A screw-type collar is depicted as a means for holding the feathers but it is to be noted that slide on or in collar members may be used. The toggle clamps shown in FIGS. 28, 29 and 30 may also be used to maintain a clamped together retainer to the lower housing. The bayonet-type lock depicted in FIG. 26 may be used with any and all wedge securings to the rod end of the piston. In addition to those shown, there are many combinations that may be used to secure the wedge to the rod end.

The present invention provides a means for converting commercially used apparatus to a readily inspected and repairable assembly. The clamp shell members are easily opened for inspection and such inspection is encouraged at every change of shift or period of use. A close fit of the piston rod in the lower band is not desired in the present apparatus since a bit of play of the wedge as it is advanced between the feathers allows a degree of self-centering not found in known apparatus. What is desired is a ready opening of the retaining means allowing for inspection and repair of the feathers, wedge, wear plates, rubber shield members and/or the clamp shell members.

The rotary pulsation means as shown in FIGS. 21 and 22 is only an embodiment suggesting a means for pulsing the movement of the wedges between the feathers. The forward movement of the wedge becomes progressively slower as an outward force on the rock is increased. The tendency of the faces of the wedge to freeze to the cooperating faces or surfaces of the feathers also increases with the side force to be exerted by the wedge. A rapid but short reversal of the forward thrust of the wedge allows a momentary relaxation of the freezing of the wedge in between the feathers. A similar result is achieved with the pulsations or vibrations provided by a jack hammer addition as shown.

As a method the above apparatus provides means for mechanically splitting rock and the like in which a sliding wedge is moved to and between like feathers which as a unit are inserted into predrilled holes, the wedge moved by a hydraulic piston, the movement of this wedge causing a sideways movement of the opposed feathers, said method including the steps of: providing a housing apparatus including a hydraulic cylinder having a piston and a piston rod extending from and through one closing end of the cylinder; controlling a flow of pressurized fluid selectively to either side of the piston while returning that fluid on the other side of the piston at that instant to a recovery supply; removably mounting a slider wedge to the rod end of the piston, the wedge movable with the rod end as it is moved by the piston and forming the wedge with opposed faces and with tapered sliding surfaces; forming a mounting and positioning means on the lower end of the housing apparatus from which end the rod end extends and moves; providing a pair of feathers each having an enlarged upper end retaining means formed thereon and forming each feather with a finished inner face adapted to mate with and present a sliding surface to the wedge when passed therebetween with the increasing taper of the wedge urging the feathers apart; providing a split clamp shell for removably securing to the mounting and retaining means of the lower housing, the clamp shell having a recess formed to retain the upper ends of the feathers against the mating surfaces of the wedge when the clamp shell is secured in position and is in a closed condition, and in an open position the wedge and feathers can be easily inspected for damage, wear and the like, and securing and maintaining the split clamp in a closed and secured position on the lower end of the housing apparatus by a clamp being readily manipulable to close and open the split clamp.

Terms such as "left", "right", "up", "down", "bottom", "top", "front", "back", "in", "out" and the like are applicable to the embodiments shown and described in conjunction with the drawings. These terms are merely for the purpose of description and do not necessarily apply to the position in which the rock splitting apparatus may be constructed or used.

While particular embodiments of the apparatus have been shown and described it is to be understood the invention is not limited thereto since modifications may be made within the scope of the accompanying claims and protection is sought to the broadest extent the prior art allows.

What is claimed is:

1. Apparatus for mechanically splitting rock and the like by a sliding wedge which moves between like opposed feathers to move them apart, the wedge and feathers inserted into predrilled holes and the wedge moved by a hydraulic piston, the movement of said wedge being translated into a substantially like sideways movement of the opposed feathers, said apparatus including: (a) a housing apparatus including a hydraulic cylinder having a piston and a piston rod extending from and through one closing end of the cylinder; (b) means for controlling a flow of pressurized fluid selectively to either side of the piston while returning that fluid on the other side of the piston at that instant to a recovery supply; (c) a slider wedge removably mountable and secured to the rod end of the piston and movable with the rod end as it is moved by the piston, the wedge having opposed faces formed with tapered sliding surfaces; (d) a mounting and positioning means formed and provided on the lower end of the housing apparatus from which end the rod end extends and moves; (e) a pair of feathers each having an enlarged upper end retaining means formed thereon, each feather having a finished inner face adapted to mate with and present a sliding surface to the wedge when passed therebetween with the increasing taper of the wedge urging the feathers apart; (f) a split clamp shell having means for removably securing said clamp shell to the mounting and retaining means of the lower housing, the clamp shell having a recess formed to retain the upper ends of the feathers against the mating surfaces of the wedge when the clamp shell is secured in position and is in a closed condition, and in an open position the wedge and feathers can be easily inspected for damage, wear and the like, the split clamp shell housing including complementary formed inner and outer surfaces in the mating members so that the split clamp shell housing when closed in place is a snug fit on the outer lower surface of the housing apparatus and the positioning means includes a groove formed in one of the mating members and a ring portion in the other member, the ring portion sized to mate with and seat in said groove, and (g) a clamp means for securing and maintaining the split clamp in a closed and secured position on the lower end of the housing apparatus, this clamp means being readily manipulable to close and open the split clamp.

2. Apparatus for splitting rock as in claim 1 in which the mounting and positioning means includes at least one groove formed in the housing apparatus and on the split clamp shell housing at least one ring portion sized to mate with and seat in said groove.

3. Apparatus for splitting rock as in claim 2 in which there are two grooves formed in the lower end of the housing apparatus and there are two ring portions formed in the split clamp housing, the ring portions spaced and sized to mate with and seat in said grooves.

4. Apparatus for splitting rock as in claim 2 in which there is additionally formed in the split clamp shell housing a recess for positioning and retaining a wear plate immediately below and in thrust adjacency to the enlarged portions of the feathers and there is provided such a wear plate at assembly.

5. Apparatus for splitting rock as in claim 4 in which there is additionally formed in the split clamp shell housing a recess for positioning and retaining and there is provided in said recess a wear plate immediately above and in thrust adjacency to the enlarged portions of the feathers.

6. Apparatus for splitting rock as in claim 4 in which there is additionally formed in the split clamp shell housing a recess for positioning and retaining and there is provided in said recess a rubber dust stop shield which is positioned adjacent the lower end of the split shell housing, this rubber stop locally enclosing the feather pairs and urging them toward the wedge.

7. Apparatus for splitting rock as in claim 1 in which the clamp means for securing and maintaining the split clamp in a closed and secured position is a strap drawn into a closed condition by a screw and thread means.

8. Apparatus for splitting rock as in claim 1 in which the clamp means for securing and maintaining the split clamp in a closed and secured position is a quarter-turn screw with a bent end, the body of which is retained in a hole in one of the split clamp shell housings and the other portion of the turnscrew carried in a slot in the other clamp shell housing with the bent end engaging an abutment adjacent the slot when the screw is turned at least a quarter turn.

9. Apparatus for splitting rock as in claim 1 in which the clamp means for securing and maintaining the split clamp in a closed and secured position is a snap toggle clamp carried by and pivotally retained by one of the split clamp shell housings and on the other clamp shell housing is provided an ear portion which is engaged by the toggle clamp as the clamp shell portions are drawn together and maintained in a clamped together condition by the toggle clamps.

10. Apparatus for splitting rock as in claim 1 in which the hydraulic cylinder includes a tubular body with the closed end a separate member mounted to this tubular body by bolts which enter threaded holes in the tubular body and with the rod end a separate member also mounted to this tubular body by bolts which enter threaded holes in the tubular body.

11. Apparatus for splitting rock as in claim 1 in which the rod end is formed with a clevis end and the slider wedge end is insertable in this clevis end and the clevis and wedge end are secured in a pivoted relationship by a transverse pin passing through like-sized holes in the clevis and wedge ends.

12. Apparatus for splitting rock as in claim 1 in which the mounting and positioning means is formed on a lower barrel assembly which is screwed in place in the hydraulic cylinder portion of the apparatus, this lower barrel assembly being terminated at a point above the securing means for attaching the wedge to the rod end of the cylinder, this remaining terminated lower barrel assembly having two grooves formed in its exterior surface to provide the mounting and positioning means.

13. Apparatus for splitting rock as in claim 1 in which the rod end is tubular with a plurality of transverse holes by and through which a pin may be selectively, longitudinally positioned to secure the slider wedge in a selected position with relation to the forward extent of movement of the piston.

14. Apparatus for splitting rock as in claim 1 in which the wear plates are made in an elongated U-shape with a wear plate above and below the enlarged upper end of the feathers, these wear plates adapted to engage only the enlarged end of one feather.

15. Apparatus for splitting rock as in claim 14 in which the split clamp shell is formed in its lower end with a U-shaped, tapered-shaped groove in which a resilient member is mounted, this resilient member adapted to locally engage the outer surface of the feathers and urge the engaged feather toward and to the tapered slide wedge.

16. Apparatus for splitting rock as in claim 1 in which rearward stroke of the piston in the cylinder is adjustably limited by a screw member carried in the closed end of the cylinder, this screw carried in threads formed in the head end member and as the screw member is advanced the inward end of the screw is brought in way of the end of the piston to limit the travel of the piston toward the closed end of the cylinder, the screw having locking means thereon and there is provided an auxiliary closure by which any leak past the threads of the screw member is confined by the auxiliary closure.

17. Apparatus for splitting rock as in claim 1 in which the forward stroke of the piston in the cylinder is limited by a collar member carried by and fastened to the rod end closure of the cylinder, this collar member having a passageway through which the rod of the piston freely passes, the inward extent of the collar member being the limiting apparatus by which the forward stroke of the piston is inhibited when the forward face of the piston comes in way of the collar member.

18. Apparatus for splitting rock as in claim 1 in which the rearward stroke of the piston in the cylinder is limited by a plug member carried by and fastened to the closed end of the cylinder, this mounted plug member protruding into the chamber to limit the rearward stroke of the piston which is stopped when the end of the piston comes in way of the mounted plug member.

19. Apparatus for rock splitting as in claim 18 in which the plug member is constructed with a flange portion through which mounting bolts pass for securing the plug member in place.

20. Apparatus for splitting rock as in claim 1 in which the rearward stroke of the piston in the cylinder is limited by a plug member carried by and fastened to the closed end of the piston, this mounted plug member movable with the piston and as the piston is moved toward the closed end of the cylinder the plug member engages the closed end of the cylinder to limit the rearward stroke of the piston which is stopped when the plug member comes in way of the closed end of the cylinder.

21. Apparatus for rock splitting as in claim 20 in which the plug member is constructed with a flange portion through which mounting bolts pass for securing the plug member in place.

22. Apparatus for splitting rock as in claim 1 in which there is provided in each of the clamp shell members provisions to receive and retain a pair of transverse pins and each feather has an elongated slot through which only one of the pins passes, this slot formed so that each feather may move in accordance with the taper formed on the slider wedges.

23. Apparatus for splitting rock as in claim 1 in which there is provided a collar member having clevis hinge portions formed on opposite sides, each clevis adapted to receive a formed upper end of a feather, this formed end and other clevis hinge portions being assembled in a hinged relationship with a pin, this collar member and the attached feathers being retained in a recess formed in the split clamp shell housing when the clamp shell housing is in a closed condition.

24. Apparatus for splitting rock as in claim 1 in which there is provided in each of the clamp shell members provisions to receive and retain a pair of transverse pins and each feather has its upper retaining ends formed with outwardly extending wing portions with two spaced-apart holes formed in each feather, these holes axially aligned with the outward movement of the feathers as caused by the taper on the wedge, the pins and feathers retained in the closed clamp shell members whereby the feathers are able to move in accordance with the taper on the wedge.

25. Apparatus for splitting rock as in claim 1 in which the enlarged ends of the feathers are formed with a transverse support surface and protruding from this surface is a locating pin on which is removably mounted a wear plate.

26. Apparatus for splitting rock as in claim 25 in which the support surface and wear plate is on the upper end of the feather.

27. Apparatus for splitting rock as in claim 25 in which the support surface and wear plate is on the underside of the enlarged end of the feather.

28. Apparatus for splitting rock as in claim 1 in which the wedge is additionally formed with an extending upper end, this extending end providing a guide for the mounting and securing thereon of a guide collar by which transverse movement of the wedge in a plane midway of the taper of the wedge is restricted to a maximum of one-quarter inch from a nominal axial position.

29. Apparatus for splitting rock as in claim 28 in which the securing of the collar to the extending upper end of the wedge includes a pin passing through and being retained in appropriate holes formed in the collar and wedge extension.

30. Apparatus for splitting rock as in claim 1 in which the enlarged upper and retaining means of the feathers are additionally retained in formed socket portions which are slidably mounted in a groove formed in the split clamp shell and there is additionally provided a rubber-like ring mounted in this groove and adapted to urge the sockets and feathers toward and to the tapered wedge.

31. Apparatus for splitting rock as in claim 1 in which the enlarged ends of the feathers are contoured to provide a curved surface for a swivel movement in and by the feathers, this swivel movement being guided by upper and lower wear plates retained in a groove in the split clamp shell portions, the upper wear plate having a concave undersurface and the lower wear plate having a convex upper surface, these contoured surfaces of the wear plates and the feathers providing a limited pivotal swing of these feather ends in these wear plate surfaces.

32. Apparatus for splitting rock as in claim 31 which further includes a rubber-like ring which engages the outer portions of the enlarged portions of the feathers to urge the upper portions of the feathers toward and to the tapered wedge.

33. Apparatus for splitting rock as in claim 1 in which by an automatic valve apparatus pressurized fluid to the piston is cycled from the closed end side to the rod end side of the piston, this valve apparatus automatically providing a time cycle in which flow to the closed end of the piston is more than one-half of a cycle and flow to the rod end of the piston is less than one-third of a time cycle, the valve apparatus automatically returning to a collecting means that fluid in the cylinder on the side that is not at that time receiving pressurized fluid.

34. Apparatus for splitting rock as in claim 33 in which the valve apparatus is a rotary valve which as it is rotated one full revolution provides at least two full cycles.

35. Apparatus for mechanically splitting rock and the like by a sliding wedge which moves between like opposed feathers to move them apart, the wedge and feathers inserted into predrilled holes and the wedge moved by a hydraulic piston, the movement of said wedge being translated into a substantially like sideways movement of the opposed feathers, said apparatus including: (a) a housing apparatus including a hydraulic cylinder having a piston and a piston rod extending from and through one closing end of the cylinder; (b) means for controlling a flow of pressurized fluid selectively to either side of the piston while returning that fluid on the other side of the piston at that instant to a recovery supply; (c) a slider wedge removably mountable and secured to the rod end of the piston and movable with the rod end as it is moved by the piston, the wedge having opposed faces formed with tapered sliding surfaces; (d) a mounting and positioning means formed and provided on the lower end of the housing apparatus from which end the rod end extends and moves; (e) a pair of feathers each having an enlarged upper end retaining means formed thereon, each feather having a finished inner face adapted to mate with and present a sliding surface to the wedge when passed therebetween with the increasing taper of the wedge urging the feathers apart; (f) a split clamp shell in which the split is in a plane generally parallel to the axis of the hydraulic piston rod and the slider wedge as and when mounted, this split clamp shell further having means for removably securing said clamp shell to the mounting and retaining means of the lower housing, the clamp shell having a recess formed to retain the upper ends of the feathers against the mating surfaces of the wedge when the clamp shell is secured in position and is in a closed condition, and in an open position the wedge and feathers can be easily inspected for damage, wear and the like, and (g) a clamp means for securing and maintaining the split clamp in a closed and secured position on the lower end of the housing apparatus, this clamp means being readily manipulable to close and open the split clamp.

* * * * *